United States Patent [19]

Shaiu

[11] Patent Number: 4,646,471

[45] Date of Patent: Mar. 3, 1987

[54] RECOVERING APPARATUS FOR DOORS AND THE LIKE

[76] Inventor: Fuei-Tzong Shaiu, 297 Pao An Li, Pei She Wei District, Chia I City, Taiwan

[21] Appl. No.: 573,514

[22] Filed: Jan. 25, 1984

[51] Int. Cl.[4] ..... E05D 15/06

[52] U.S. Cl. ..... 49/231; 49/229; 49/357; 49/411

[58] Field of Search ..... 49/404, 231, 229, 228, 49/230, 409, 410, 411, 357

[56] References Cited

U.S. PATENT DOCUMENTS

| | | | |
|---|---|---|---|
| 1,012,478 | 12/1911 | Swain | 49/231 |
| 1,133,431 | 3/1915 | Doering | 49/231 X |
| 1,576,098 | 3/1926 | Deitz | 49/228 |
| 1,767,650 | 6/1930 | Cangemi | 49/230 |
| 1,820,941 | 9/1931 | Hawks | 49/229 X |
| 2,755,080 | 7/1956 | Huner | 49/231 |
| 3,805,450 | 4/1974 | Forcina | 49/231 |

*Primary Examiner*—Philip C. Kannan

[57] ABSTRACT

A recovering apparatus for the doors includes a pair of guiding means having rolling medium mounted on door, a horizontal frame for moving the guiding means therein, and an inclined rail adjusted by a screw held in the horizontal frame whereby the door with the rolling medium, once being opened, can be automatically closed by its potential energy as rolling down along the inclined rail.

1 Claim, 11 Drawing Figures

RECOVERING APPARATUS FOR DOORS AND THE LIKE

BACKGROUND OF THE INVENTION

Conventional door-closer can be used to automatically close an opened door. Such a door-closer includes a spring acting to close an opened door and a hydraulic cylinder filled with oil to slow the door-closing movement. When opening a door installed with such a door-closer, it requires a large force to counteract the resilience force of the spring in the door-closer, to thereby cause the tiredness of the door passer.

The present inventor has found the defect of conventional door-closer and invented the present recovering apparatus for the doors or the like.

SUMMARY OF THE INVENTION

The object of the present invention is to provide a recovering apparatus for the doors including a pair of guiding means having guiding wheels and rolling medium mounted atop on a door, a horizontal frame formed with two vertical walls for rolling the guiding wheels of the guiding means, and formed with a lengthy groove on the lower edge of a vertical wall for receiving a rail, and an inclined rail adjusted by a slope-adjusting means or having an inclined top surface for rotatably loading the rolling medium of the guiding means so that the door can be smoothly opened by raising the door along the rail, and can be automatically closed by its potential energy as rolling down along the inclined rail provided in the horizontal frame.

Another object of the present invention is form a bottom groove under the door and to fix a guiding wheel on the floor beneath the door to slidingly engage with the bottom groove of the door. Still another object of the present invention is to provide a cushioning means resiliently extending a wheel downwards to touch the floor whereby the impact force exerted, when rolling down the door along the inclined rail, will be buffered to eliminate any violence or damage.

Further object of the present invention is to provide a pausing means fixed on the lower portion of a door, in which a rod can be resiliently braked on the floor beneath the door so as to temporarily stop the door at any optional opening position.

The other object of the present invention is to provide an actuating means to open the door without hand-push as trodden by any intruder's feet.

The present invention may better be understood with reference to the accompanying drawings, in which:

DETAILED DESCRIPTION OF THE PREFERRED EMBODIMENT

Figure 1:
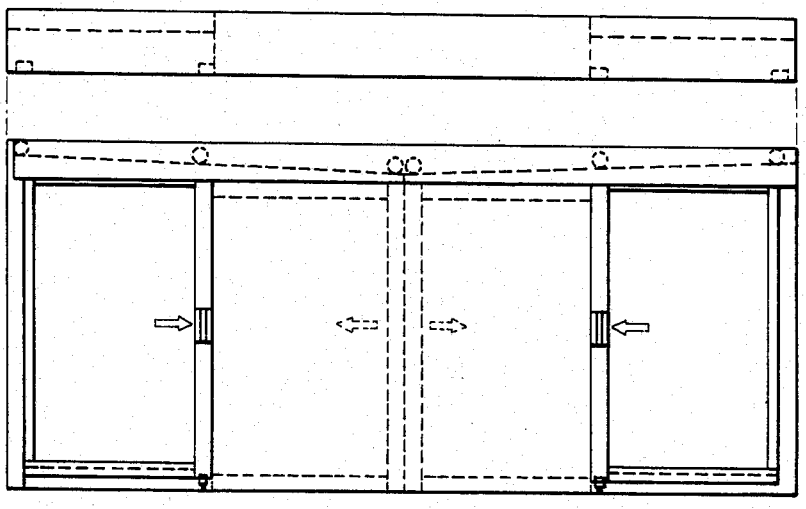
FIG. 1 is a schematic view showing a recovering apparatus for doors of the present invention in use.
Figure 2D:
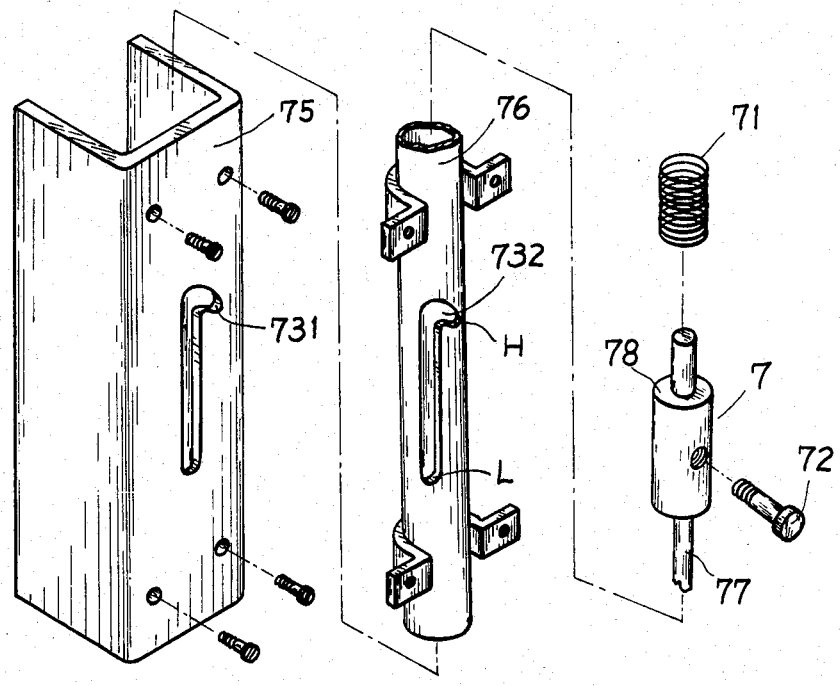
FIG. 2D is an exploded view showing a preferred embodiment of a pausing means of a recovering apparatus for doors of the present invention.
Figure 2A:
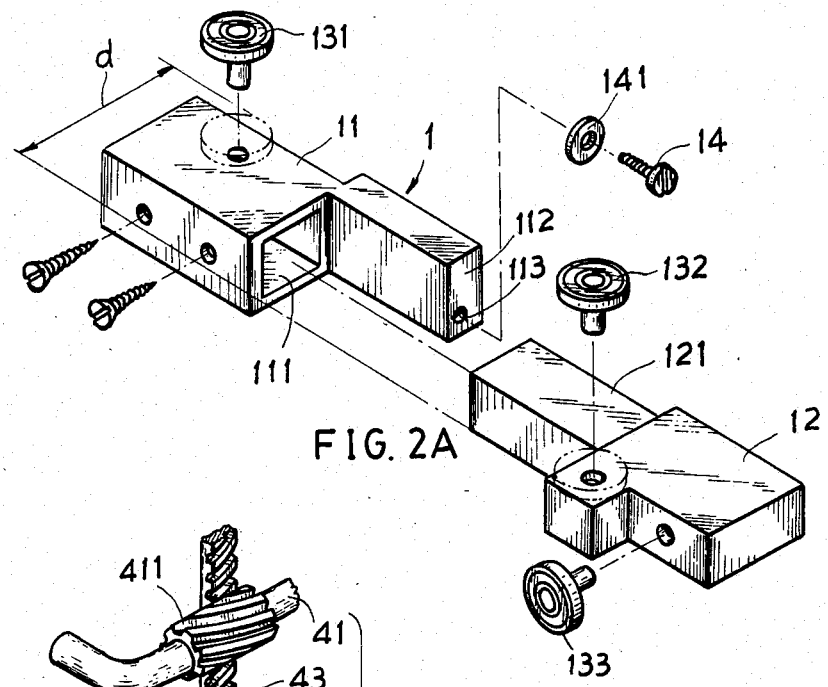
FIG. 2A is an exploded perspective view showing a preferred embodiment of a guiding means of a recovering apparatus for doors of the present invention.
Figure 2B:
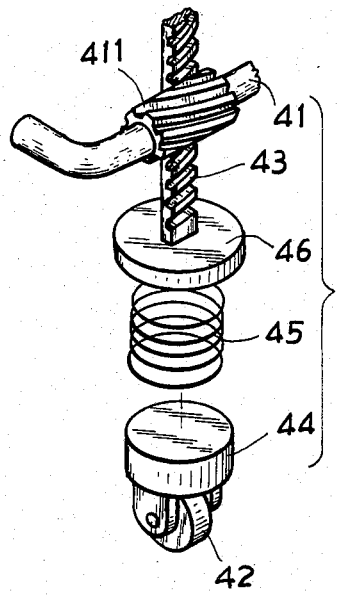
FIG. 2B is a perspective view showing a preferred embodiment of a cushioning means of a recovering apparatus for doors of the present invention.
Figure 2C:
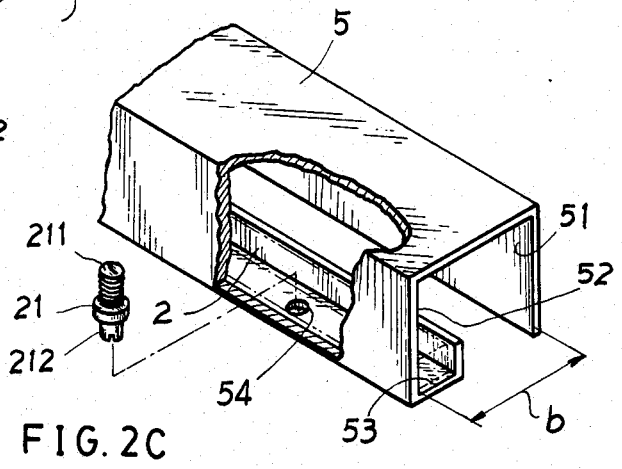
FIG. 2C is a fragmentary view showing a horizontal frame, an inclined rail and an adjusting means of a recovering apparatus for doors of the present invention.
Figure 3A:
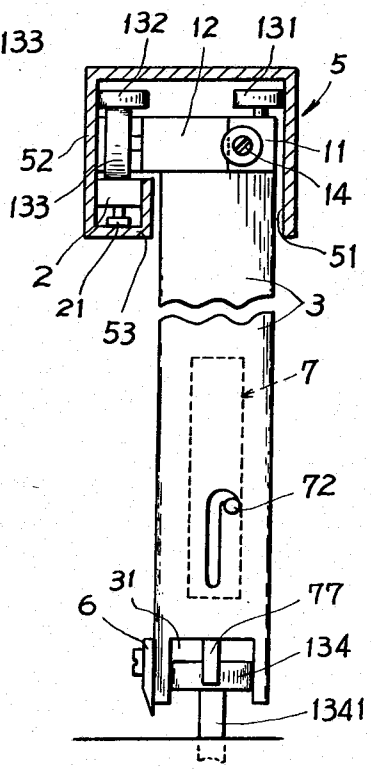
FIG. 3A is a sectional view of FIG. 3 in accordance with the present invention.
Figure 3:
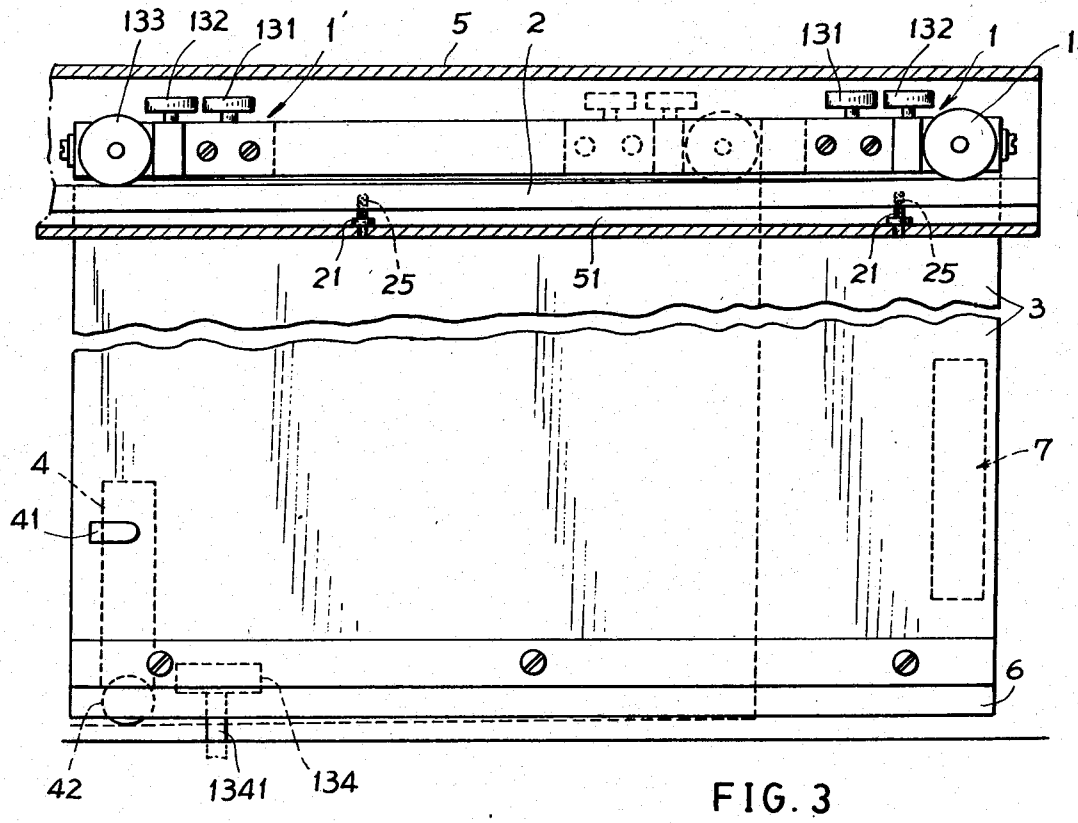
FIG. 3 is a sectional view showing a preferred embodiment of a recovering apparatus for doors incorporating a door.
Figure 4:
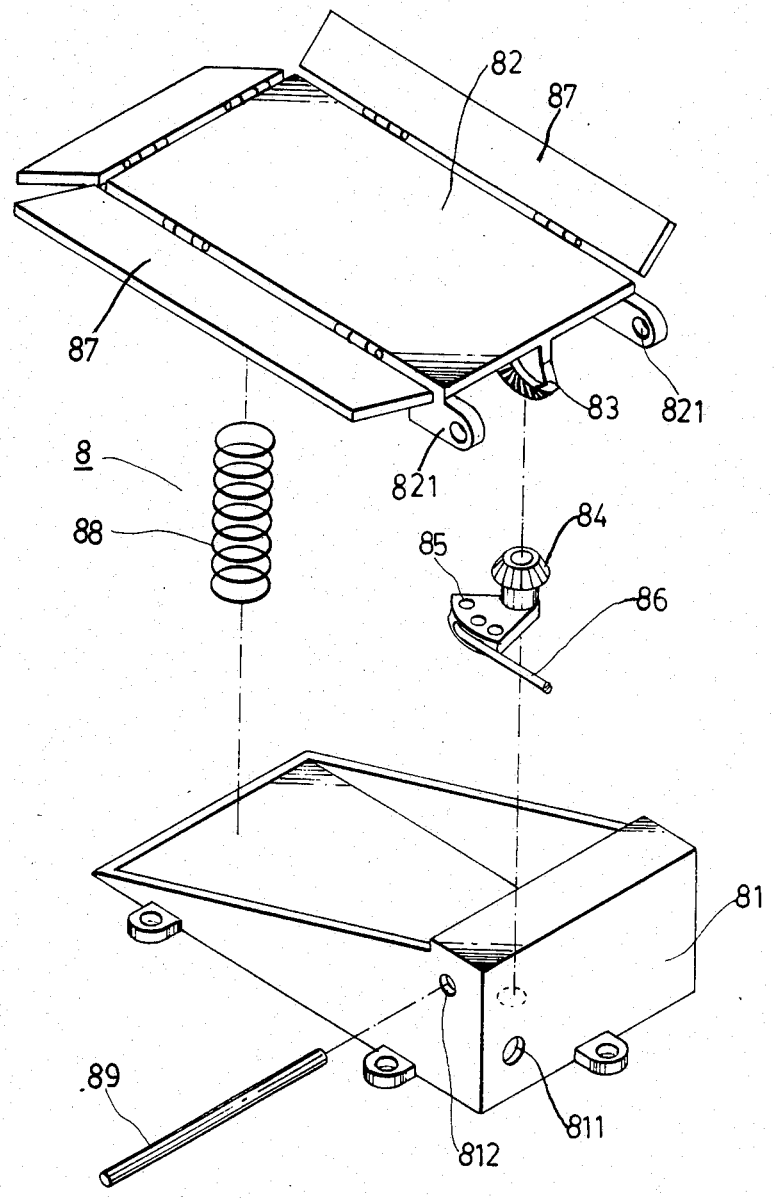
FIG. 4 is an exploded view of a preferred embodiment of an actuating means of a recovering apparatus for doors of the present invention.
Figure 5:
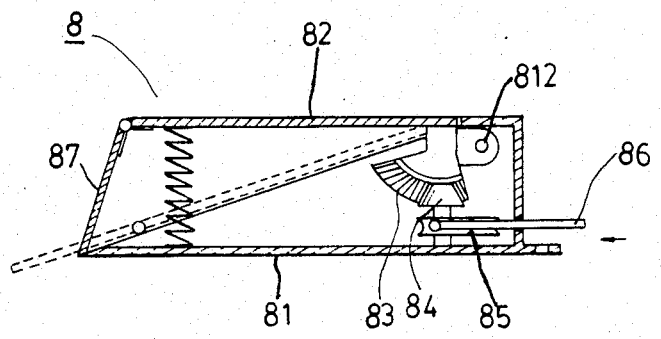
FIG. 5 is a sectional view of a preferred embodiment of an actuating means of a recovering apparatus for doors.
Figure 6A:
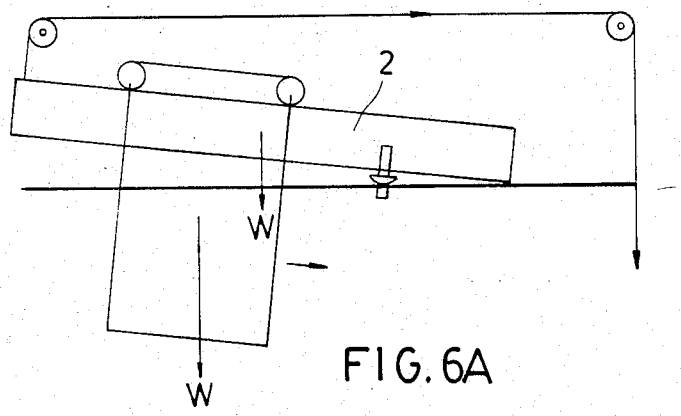
FIG. 6A shows the operation principle to open a door by the actuating means of the present invention.
Figure 6B:
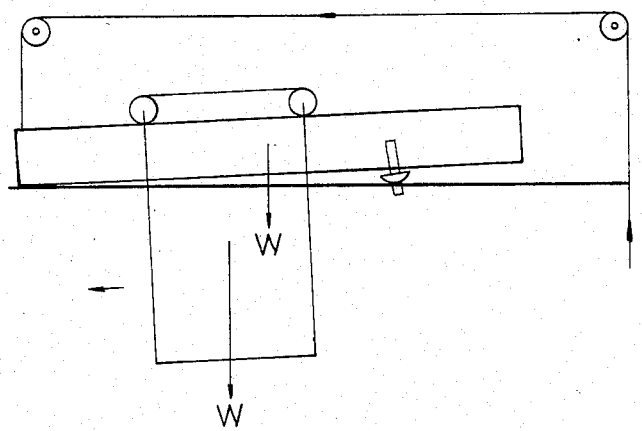
FIG. 6B shows the operation to close a door when releasing the actuating means of the present invention.

Referring now to FIG. 3, there is shown a preferred embodiment of a recovering apparatus for doors of the present invention including a pair of guiding means 1 and means 1' mounted on the top portion of a door 3 of which the bottom portion is formed with a longitudinal groove 31 across the width of the door 3, an inclined rail 2 adjusted by a slope adjusting means 21 or having an inclined surface for variating the slope of rail 2, a cushioning means 4, a horizontal frame 5 and a pausing means 7. In FIG. 2A, FIG. 2B, FIG. 2C and FIG. 2D, there are detailedly shown guiding means 1, cushioning means 4, horizontal frame 5 and inclined rail 2 as well as pausing means 7 respectively. Guiding means 1 includes a first piece 11 mounted atop on door 3 and having a hole 111, a first guiding wheel 131 fixed on first piece 11 and rolling along a first vertical wall 51 of frame 5 when door 3 is thrusted to open or close, a second piece 12 having a protrusion 121 inserted into hole 111 and incorporated with first piece 11 by engaging a screw 14, through a washer 141, with a threaded hole 113 formed on a side portion 112 of first piece 11, a second guiding wheel 132 fixed to second piece 12 and rolling along a second vertical wall 52 of frame 5 and a rolling medium 133 fixed on second piece 12 and capable of rolling along the inclined rail 2. Frame 5 is formed with a lengthy groove 53 on the lower edge of vertical wall 52 for receiving rail 2. The slope-adjusting means 21 for rail 2 is a screw, which is upperly formed with a male-threaded head 211 engaged with a female-threaded hole 25 formed under rail 2, and lowerly formed with an extension 212 through a hole 54 formed on the groove 53 so that a driver can be used to adjust the screw and the slope of rail 2. Also, two screws 21 may be laterally provided under rail 2 to adjust the rail slope. Since first piece 11 is fixed on door 3 and the width d disposed by the extremities of both guiding wheels 131, 132 is equal to the inside width b between the two walls 51, 52 of frame 5, the door with rolling medium 133 may smoothly and stably roll along the inclined rail 2. Both first and second vertical walls 51, 52 extend downwards from the frame 5 to form an inversed U shape from its sectional view as shown in FIG. 3A. The rail 2 is mounted on the groove 53 of horizontal frame 5. The lengthy groove 53 is protruded inwards from the lower edge of the second vertical wall 52 so that the overall sectional view of frame 5 is formed as a G shape. Door 3 incorporating with such a recovering apparatus will return to its original position by the transportation of guiding means 1 along the inclined surface of inclined rail 2 to release a potential energy which is stored when door 3 is raised along the inclined surface of rail 2. A bottom guiding wheel 134 having a shaft 134 is vertically fixed on the floor beneath door 3. The door 3 is lowerly formed with a bottom groove 31 to slidingly engage with the guiding wheel 134 as shown in FIG. 3. A shield 6 is attached to the bottom of door 3 for dust proof and better shielding. Cushioning means 4 includes an adjusting rod 41 pivotedly formed on the door 3, rack 43 reciprocatively and vertically mounted on the lower portion of door 3 and engaged with a worm 411 formed on the adjusting rod 41 for its vertical adjustment by the adjusting rod 41, a first plate 46 connected under rack 43, a second plate 44 lowerly connected with a wheel 42 resiliently touching the floor beneath the door and a spring 45 vertically connected between plate 46 and plate 44 so that the impact force exerted, when rolling the door 3 down the rail 2, will be buffered by the spring 45. Pausing means 7 includes a mounting frame 75 fixed on the lower portion of door and formed with a lengthy slit 731, a tube 76 mounted on frame 75 and having a slit 732 corresponding to groove 731, a braking rod 77 formed on the lower portin of a cylindrical head 78, both head 78 and rod 77 being moved and jacketed into tube 76, a spring 71 tensioning head 78 downwards and a pin 72 transversely fixed on head 78 and extending outwards through slit 731, 732 so that the rod 77 can be resiliently braked on the floor beneath the door 3 at any desired position when pin 72 is riding on a lower position L and door 3 is free moved when pin 72 is locked on hook groove H at a higher position on slits 731, 732 as shown in FIG. 2D. In order to open the door with hand-push, an actuating means 8 is further provided to open the door as trodden by any intruder's feet. Actuating means 8 includes a base piece 81 having a rope hole 811 and two pins holes 812, a bevel gear 84 rotatably mounted on base piece 81, an actuating plate 82 having two pivoting holes 821 and covering plates 87, a sector gear 83 fixed under plate 82 for engaging with bevel gear 84, a spring 88 mounted between plate 82 and piece 81, a pin 89, passing through holes 821, 812, for pivotting plate 82 on piece 81 and a rope 86 having one end fixed to a fixing piece 85 attached to bevel gear 84 and the other end fixed through hole 811 to the inclined rail 2 as shown in FIG. 4 and 6A. FIG. 5 shows a sectional view of actuating means 8. FIG. 6A schematically shows that a door is actuated to open along the inclined surface of inclined rail 2 when actuating means is pressed by one's feet and thus bevel gear 84 is rotated to pull rope 86 and inclined rail 2 for rolling down the door 3 along rail 2. FIG. 6B schematically shows that the door recovers to its original position when actuating means 8 is released to free rope 86.

While the present invention has been described in connection with what is presently considered to be the most practical and preferred embodiment, it is to be understood that the invention is not to be limited to the disclosed embodiments but on the contrary, is intended to cover various modifications and equivalent arrangements included within the spirit and scope of the appended claims which scope is to be accorded the broadest interpretation so as to encompass all such modifications and equivalent structures.

What I claim is:

1. A recovering apparatus for a door comprising:

a horizontal frame having a first vertical wall and a second vertical wall opposite to said first vertical wall, both said vertical walls respectively extending downwards from an upper horizontal wall of said frame to form a U-shape of its cross sectional view, and a longitudinal groove protruding transversely from the lower edge of said second vertical wall towards said first vertical wall for mounting a rail thereon;

a rail, mounted on said longitudinal groove of said horizontal frame, having a screw adjustably mounted on said longitudinal groove and formed under said rail to form an inclined surface for said rail on said horizontal frame; and a pair of guiding meanses mounted on a door, each said guiding means including: a first guiding wheel fixed on a first piece fixed on the door with an axis of said first guiding wheel vertically perpendicular to said first piece, and rolling along said first vertical wall of said horizontal frame, and a second guiding wheel fixed on a second piece combined to said first piece with an axis of said second guiding wheel vertically perpendicular to said second piece, and rolling along said second vertical wall of said horizontal frame, and a rolling medium fixed on said second piece having an axis of said rolling medium horizontally perpendicular to said second piece and rolling along said rail having an inclined surface thereof, the width transversely defined by both said first and second guiding wheels being equal to the inside width of said horizontal frame as defined between said first vertical wall and said second vertical wall, whereby upon the opening of the door as rising along said inclined surface of said rail, said door will be automatically closed by its potential energy as stored when rising said door and as released when rolling down said door along said rail on said horizontal frame.

* * * * *